United States Patent [19]

Turner

[11] 4,237,627

[45] Dec. 9, 1980

[54] RUNNING SHOE WITH PERFORATED MIDSOLE

[75] Inventor: Jerome A. Turner, Baltimore, Md.

[73] Assignee: Turner Shoe Company, Inc., Aquadilla, P.R.

[21] Appl. No.: 9,993

[22] Filed: Feb. 7, 1979

[51] Int. Cl.[3] ..... A43B 5/00; A43B 7/06; A43B 13/20

[52] U.S. Cl. ..... 36/129; 36/3 B; 36/29

[58] Field of Search ..... 36/129, 29, 28, 3 R, 36/3 B

[56] References Cited

U.S. PATENT DOCUMENTS

| | | | |
|---|---|---|---|
| 231,830 | 8/1880 | McDonald | 36/3 B |
| 1,248,873 | 12/1917 | Larson | 36/3 R |
| 2,327,361 | 8/1943 | Margolin | 36/3 B |
| 2,334,719 | 11/1943 | Margolin | 36/3 B |
| 2,884,716 | 5/1959 | Shelare et al. | 36/3 R |
| 4,043,058 | 8/1977 | Hollister et al. | 36/28 X |
| 4,063,371 | 12/1977 | Batra | 36/3 B |

FOREIGN PATENT DOCUMENTS

| | | | |
|---|---|---|---|
| 526712 | 5/1955 | Italy | 36/3 B |

*Primary Examiner*—James Kee Chi

*Attorney, Agent, or Firm*—Caesar, Rivise, Bernstein & Cohen, Ltd.

[57] ABSTRACT

A running shoe having an outer sole and a midsole. The midsole includes two groups of apertures extending therethrough. The first group of apertures is located in the forefoot portion of the midsole and a second group of apertures is located to the rear of the first group and contiguous with the arch portion of the midsole. The apertures in each group are disposed in an array of transverse rows, with the apertures in the first group being disposed closer to one another than the apertures in the second group.

18 Claims, 5 Drawing Figures

FIG. 1
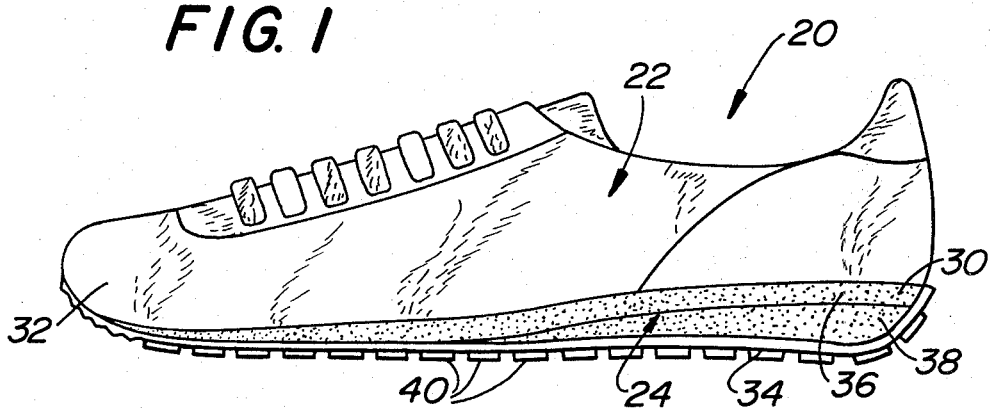
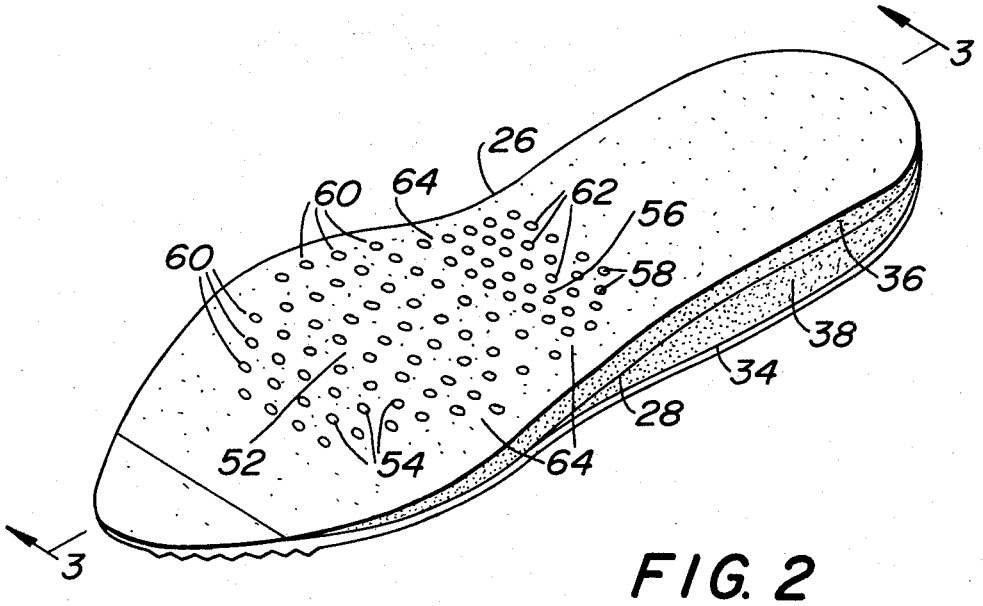
FIG. 2

RUNNING SHOE WITH PERFORATED MIDSOLE

This invention relates generally to athletic shoes and, more particularly, to running shoes and midsoles therefor.

The sole structure of most running shoes commercially available today is of a tripartite construction including an outer sole, a midsole and an inner sole. The outer sole is normally formed of a tough, abrasion resistant material since it is the portion of the sole which contacts the ground. The midsole is the portion of the shoe between the outer sole and the inner sole and its function is to provide lift for the heel and cushioning for the entire shoe.

As is recognized by those skilled in the running shoe art, as well as those millions of recreational runners, good impact absorption and flexibility are two extremely important characteristics desired in running shoes. This is particularly true where the shoes are used for long-distance running. Accordingly, ideally the running shoe sole should permit a great deal of flexibility at the point where the foot naturally flexes, while being sufficiently tough to withstand shock, yet soft enough to provide adequate cushioning and comfort. Since the outer sole must be sufficiently tough to withstand abrasion the attention of shoe designers has been directed to the midsole for effecting increased flexibility, shock absorption and cushioning.

While very soft materials for the midsole, e.g., materials of approximately 20 durometer or less, may exhibit good flexibility and cushioning, such materials are not suitable for use in a running shoe since they soon collapse and become virtually useless for absorbing shock. Accordingly, harder materials, e.g., 35 durometer or more, are commonly used in the midsoles of most quality running shoes commercially available today since such materials have been found to exhibit a good combination of flexibility, shock absorption, cushioning and longevity. The use of such harder material midsoles represents a compromise and, as such, still leaves much to be desired from the standpoint of flexibility, shock absorption and cushioning in a durable running shoe.

Accordingly, it is a general object of the instant invention to provide a midsole for a running shoe which overcomes the disadvantages of the prior art.

It is a further object of the instant invention to provide a midsole for a running shoe which may be formed of conventional materials, yet which provides greater flexibility than prior art midsoles.

It is still a further object of this invention to provide a midsole for a running shoe which may be formed of conventional materials and which provides good forefoot shock absorption and cushioning, while also providing greater flexibility at the portion of the sole at which natural flexing occurs than prior art midsoles.

It is yet a further object of the instant invention to provide a running shoe providing good forefoot shock absorption and cushioning, while also providing greater flexibility at the portion of the shoe at which natural flexing occurs than prior art shoes.

These and other objects of the instant invention are achieved by providing a midsole for a running shoe including a heel portion, an arch portion, a forefoot portion and a toe portion. The midsole is formed of a resilient material and tapers downward in thickness between the heel portion and the toe portion. The forefoot portion includes a first group of apertures extending through the midsole and disposed in an array of plural transverse rows. The midsole also includes a second group of apertures extending therethrough and located to the rear of the first group of apertures and contiguous with the arch portion. The apertures of the second group are also disposed in an array of plural transverse rows but are disposed more closely to one another than the apertures in the first group. This feature results in increased sole flexibility in the area encompassed by the second group of apertures and increased cushioning in the forefoot portion encompassed by the first group of apertures.

Other objects and many of the attendant advantages of the instant invention will be readily appreciated as the same becomes better understood by reference to the following detailed description when considered in connection with the accompanying drawing wherein:

FIG. 1 is a side elevational view of a running shoe constructed in accordance with the instant invention;

FIG. 2 is an enlarged perspective view of the sole portion of the shoe shown in FIG. 1;

Figure 3:
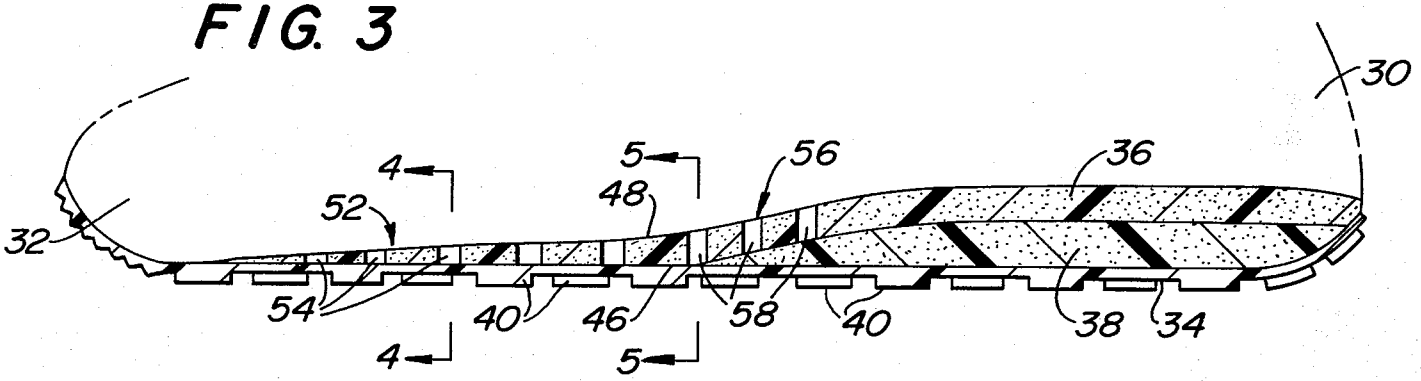
FIG. 3 is an enlarged sectional view taken along line 3—3 of FIG. 2.

Referring now to the various figures of the drawing wherein like reference characters refer to like parts, there is shown at 20 one running shoe of a pair of running shoes constructed in accordance with the instant invention. Each shoe basically comprises an upper portion 22, an inner sole (not shown) and a sole assembly 24. The upper portion 22 includes an inner or varus side 26 (FIG. 2) and an outer or valgus side 28 (FIG. 2). The sole unit 24 runs the entire length of the shoe from the heel 30 to the toe 32 and between the varus and valgus sides 26 and 28, respectively. The upper portion of the shoe is of conventional construction and for that reason will not be described in detail herein.

The sole assembly 24 of each shoe is constructed in accordance with the instant invention to provide improved cushioning with good forefoot impact shock absorption, while also providing greater flexibility at the portion of the sole at which natural flexing of the foot occurs than prior art shoes.

As can be seen in FIG. 1 the sole assembly 24 is a tripartite construction basically comprising an outer sole 34, a midsole 36 and an intermediate bevelled section 38, each formed of a resilient and flexible material, e.g., ethylene-vinyl, acetate copolymer, etc. The outer sole runs the entire length and width of the shoe and is arranged to contact the ground. In accordance with conventional construction practice, the outer sole 34 is of substantially uniform thickness throughout and includes plural gripping elements 40 projecting downward from its underside.

The midsole 36 is constructed in accordance with the teaching of the instant invention and runs from the heel of the shoe to the toe. The midsole extends the full width of the sole between the varus and valgus sides of the shoe. The bevelled section 38 is interposed and secured, e.g., glued, between the midsole and the outer sole and runs from the heel to the arch, tapering downward thereunder. The bevelled section thus provides heel lift for the shoe.

Figure 5:
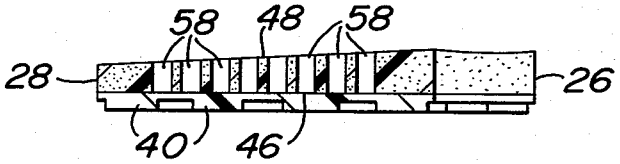
FIG. 5 is a sectional view taken along line 5—5 of FIG. 3.
Figure 4:
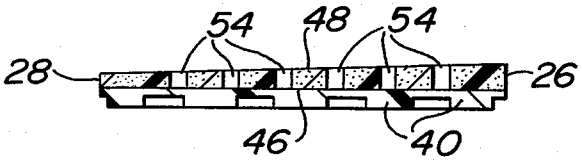
FIG. 4 is a sectional view taken along line 4—4 of FIG. 3.

As can be seen in FIGS. 4 and 5 the transverse cross-section of the midsole is wedge shaped. That is, the midsole includes a horizontal bottom surface 46 and a top surface 48 which is canted upward linearly at a slight angle, e.g., four degrees, to the horizontal transverse of the longitudinal axis of the shoe and in a direction from the valgus side 28 to the varus side 26. This upward cant extends along the midsole from the heel to a point located immediately to the rear of the location of the first metatarsal head of the wearer's foot. The upward cant of the midsole from the valgus to the varus side forms no portion of the instant invention but is the subject of U.S. Application Ser. No. 908,344, filed on May 22, 1977, assigned to the same assignee as the instant invention and whose disclosure is incorporated by reference herein.

It must be pointed out at this juncture that the midsole of the instant invention and any running shoe incorporating said midsole need not include the upward cant to achieve the ends sought herein.

It must also be pointed out at this juncture that while the midsole 36 and intermediate bevelled section 38 are shown to be two separate members secured together, it is clear that the midsole can be formed as a single integral unit and incorporating the intermediate bevelled section therein.

Research has shown that the maximum forefoot impact area in a running shoe is located approximately 32 percent to the rear of the shoe when measured from the toe area, while the maximum point of flex, i.e., the natural area of foot flexure, is located 40 percent to the rear from the toe area. Such characteristics are based on the assumption that the person running in the shoe runs at a pace of approximately six to eight minutes per mile.

In accordance with one feature of the instant invention a first group 52 of apertures 54 are provided in the midsole in an area which encompasses the forefoot portion of the midsole approximately 32 percent of the length of the sole to the rear of the toe area. In accordance with another feature of the invention a second group 56 of apertures 58 are provided in the midsole to the rear of the group 52 and in the portion wherein the forefoot portion of the midsole merges with the arch portion, i.e., approximately 40 percent of the length of the sole to the rear of the toe area.

As can be seen clearly in FIGS. 2, 3 and 4 the apertures 54 in group 52 are circular and extend entirely through the thickness of the midsole but not into the outer sole. The apertures are arranged in rows 60 which extend transversely of the sole, that is, between the varus and the valgus sides. The apertures are staggered in a longitudinal direction so that the apertures in adjacent rows do not align linearly. The spacing between the apertures 54 in each row 60 and the spacing between adjacent rows is preferably the same.

The apertures 58 in group 56 are also circular and extend entirely through the thickness of the midsole but not into the outer sole. Like apertures 54, apertures 58 are arranged in rows 62 which also extend transversely of the sole and are staggered in a longitudinal direction so that the apertures in adjacent rows do not align linearly. The spacing between the apertures 58 in each row 62 and the spacing between adjacent rows is the same but substantially less than the spacing between the apertures 54 of the group 52.

As will be appreciated by those skilled in the art the inclusion of apertures 54 in the midsole area encompassed by group 52 lessens the density of the midsole material in the forefoot area. This action produces superior cushioning thereat, without sacrificing shock absorption, and permitting the use of conventional midsole materials suitable for long life and resiliency. The more closely packed apertures 58 in the area encompassed by group 56 permits greater flexing of the midsole in the area. Since maximum forefoot shock occurs forward of the area encompassed by the apertures of group 56 the substantially reduced density of midsole material in the area of that group does not have any adverse effect on shock absorption.

As should be appreciated by those skilled in the art, the spacing between the apertures in each group and the size of the apertures in each group to best effectuate the ends of increasing cushioning in the forefoot area without impairing good shock absorption and while increasing sole flexibility, is a function of the hardness of the material making up the midsole. It has been found that for a good general purpose training flat having a midsole formed of 35 durometer ethylene-vinyl, acetate copolymer material, all the apertures can be approximately $\frac{1}{8}$ inch (3.2 mm) in diameter, with the apertures in group 52 being separated from one another by $\frac{3}{8}$ inch (9.6 mm) and with the apertures in group 56 being separated from one another by $\frac{1}{8}$ inch (3.2 mm). Such a construction provides increased cushioning in the forefoot area consistent with good shock absorption and sustained material resiliency, while providing for maximum sole flexibility at the natural flex point of the sole.

The end aperture in each row is spaced slightly from the edge of the midsole to produce margins 64 on either side of the aperture rows of both groups. The midsole is glued to the adjacent portions of the sole assembly and the upper along the margins.

It must be pointed out at this juncture that although the apertures 54 and 62 are shown as being circular, they can, of course, be of any suitable shape and can extend partially or fully through the entire thickness of the midsole. Moreover the apertures need not extend vertically into the midsole but may be at some other angle with respect to vertical. Furtherstill, the apertures can be provided in any component portion making up the body of the sole, other than the outer sole. In this regard if the bevelled section 38 were made sufficiently long, the apertures can be provided in it instead of in the midsole component.

Without further elaboration, the foregoing will so fully illustrate my invention that others may, by applying current or future knowledge, readily adapt the same for use under various conditions of service.

What is claimed as the invention is:

1. A sole component for an athletic shoe including a heel portion, an arch portion, a forefoot portion and a toe portion, said sole component being formed of a resilient material, the forefoot portion of said sole component including a first group of apertures extending into the sole component, all of said apertures in said first group being located at said forefoot portion in an array of plural transverse rows of plural apertures, each of said rows extending for substantially the full width of said sole component, said sole component including a second group of apertures extending therein, all of said apertures in said second group being located to the rear of said forefoot portion and contiguous with said arch portion, the apertures of said second group being disposed in an array of plural transverse rows of plural apertures, each of said rows extending for substantially the full width of said sole component and with said apertures being disposed closer to one another than the apertures in said first group to increase the flexibility of said sole component at the portion containing said second group of apertures.

2. The sole component of claim 1 wherein the apertures in immediately adjacent rows are staggered longitudinally.

3. The sole component of claim 2 wherein said component tapers downward in thickness between said heel portion and said toe portion.

4. The sole component of claim 1 wherein said apertures are the same diameter.

5. The sole component of claim 3 wherein said apertures are the same diameter.

6. The sole component of claim 5 wherein said apertures in said first group are approximately ⅛ inch (3.2 mm) in diameter and separated from one another by approximately ⅜ inch (9.6 mm).

7. The midsole of claim 6 wherein the apertures in said second group are separated from one another by approximately ⅛ inch (3.2 mm).

8. The sole component of claim 7 wherein the apertures at the ends of each of said rows are spaced from the edge of the sole to provide a margin therealong.

9. The sole component of claim 8 wherein said sole component is approximately 35 Durometer.

10. The sole component of claim 1 wherein said apertures extend fully through said sole component.

11. The sole component of claim 1 wherein said sole component is a midsole.

12. An athletic shoe having an upper, an outer sole and a sole component, said sole component including a heel portion, an arch portion, a forefoot portion a toe portion, said sole component being formed of a resilient material, the forefoot portion of said sole component including a first group of apertures extending into said midsole, said apertures in said first group being located at said forefoot portion in an array of plural transverse rows of plural apertures, each of said rows extending for almost the full width of said sole component, said sole component including a second group of apertures extending therein, all of said apertures in the second group being located to the rear of said forefoot portion and contiguous with said arch portion, the apertures in said second group being disposed in an array of plural transverse rows of plural apertures, each of said rows extending for substantially the full width of said sole component and with said apertures being disposed closer to one another than the apertures in said first group to increase the flexibility of said sole component at the portion containing said second group of apertures.

13. The athletic shoe of claim 12 wherein the apertures in immediately adjacent rows are staggered longitudinally.

14. The athletic shoe of claim 13 wherein said sole component tapers downward in thickness between said heel portion and said toe portion.

15. The athletic shoe of claim 14 wherein said apertures are circular.

16. The athletic shoe of claim 15 wherein all of said apertures are the same diameter.

17. The athletic shoe of claim 12 wherein said outer sole is secured to said sole component and wherein said apertures extend fully through said sole component but not into said outer sole.

18. The athletic shoe of claim 17 wherein said apertures are vertical.

* * * * *